US005303678A

United States Patent [19]

Haumann et al.

[11] Patent Number: 5,303,678

[45] Date of Patent: Apr. 19, 1994

[54] PROCESS FOR LOW-POLLUTANT COMBUSTION IN A POWER STATION BOILER

[75] Inventors: Jürgen Haumann, Rekingen; Thomas Sattelmayer, Mandach, both of Switzerland

[73] Assignee: Asea Brown Boveri AG, Baden, Switzerland

[21] Appl. No.: 966,552

[22] Filed: Oct. 26, 1992

[30] Foreign Application Priority Data

Nov. 21, 1991 [CH] Switzerland ..... 3410/91-4

[51] Int. Cl.[5] ..... F22B 33/00

[52] U.S. Cl. ..... 122/1 R; 122/14; 431/352

[58] Field of Search ..... 122/6 R, 1 R, 6 A, 14; 431/174, 181, 352

[56] References Cited

U.S. PATENT DOCUMENTS 4,023,923 5/1977 Kramer, Jr. ..... 431/352 X
4,044,683 8/1977 Ostroff ..... 431/352 X

FOREIGN PATENT DOCUMENTS 0073265 3/1983 European Pat. Off. .
0436113 7/1991 European Pat. Off. .
2534841 6/1976 Fed. Rep. of Germany .
2082314 3/1982 United Kingdom .

OTHER PUBLICATIONS

Patent Abstracts of Japan, vol. 12, No. 445 (M-767)(3292), Nov. 22, 1988—Appln. No. 62-4985, "Combustion Method and Combustion Device, etc.".

*Primary Examiner*—Edward G. Favors
*Attorney, Agent, or Firm*—Burns, Doane, Swecker & Mathis

[57] ABSTRACT

In a process for low-pollutant combustion in a power station boiler (22) for steam generation, at least one precombustion chamber (24) acts at the boiler itself, which precombustion chamber is operated with at least one burner (25*a-c*). At least a part of the primary air (26) initially flows through a heat exchanger (24*c*) , in which a caloric treatment of this air takes place to give combustion air (26*a*). This combustion air (26*a*) then flows into the burner (25*a-c*), where a mixing, and subsequent combustion with fuel (12) or with another mixture takes place. A further air stream as secondary air (27) is injected directly into the precombustion chamber (24), this taking place directly before the actual join of the precombustion chamber (24) to the boiler (22). Downstream of the precombustion chamber (24), a tertiary air stream (29) is fed into the boiler (22). Using this configuration, a process with double air staging is proposed, the boiler (22) being operated with air deficiency. As a result of this substoichiometric operation of the boiler (22), nitrogen-containing fuel compounds can be reduced.

10 Claims, 4 Drawing Sheets

PROCESS FOR LOW-POLLUTANT COMBUSTION IN A POWER STATION BOILER

BACKGROUND OF THE INVENTION

1. Field of the Invention

The present invention relates to a process according to the generic clause of claim 1. It also relates to a burner for carrying out this process.

2. Discussion of Background

In power station boilers which are operated with premixing, very low air ratios must always be used. This leads generally and inevitably to a risk of corrosion, which is not to be underestimated, as a result of the atmosphere formed with this type of combustion. Deposits can be potentially formed on the cold boiler walls, which initiate the risk of soot emission or asphalt emission. Following the burnout stage in each case, excessive temperatures result which cause a relatively high thermal NOx emission.

SUMMARY OF THE INVENTION

The invention is intended to provide assistance here. Accordingly, one object of the invention is to provide novel precautions in a process of the type mentioned in the introduction, which effect a minimization of the pollution emissions, in particular NOx emissions. The solution proposed is a process having double air staging. As a result of substoichiometric operation of a boiler, nitrogen-containing fuel compounds can be reduced. Reaction kinetic studies show a pronounced optimum for the air ratio. The reduction mechanism intensifies with increasing air preheating. The optimum shifts in this case to richer operating conditions. When fuel and air are premixed, an optimal combustion course can be realized.

The essential advantage of the invention is to be seen in that as a consequence of this knowledge, the air is preheated above the level used hitherto, before a very rich but homogeneous mixture of fuel and primary air is produced in burners, the mixture then being partially burnt in a precombustion chamber. In this case, the residence time in this precombustion chamber is selected so that the decomposition of the nitrogen compounds (TFN=total fixed nitrogen) is highly advanced.

A further advantage of the invention is to be seen in that the flame tube of the precombustion chamber can simultaneously act as a heat transfer device for the combustion air.

A further advantage is then to be seen in that a lean gas of very high temperature is present at the end of the precombustion chamber. If rapid admixing into the lean gas can then be achieved, it is possible to add a certain quantity of air to the lean gas without the TFN compounds increasing. The reason for this is that these compounds are substantially decomposed in the precombustion chamber, but the state reached is higher than results from the thermodynamic equilibrium for the mixture of primary air and secondary air.

There results therefrom a further advantage of a further reduction in the boiler evaporator after a slight TFN increase as a result of insufficiently rapid admixing processes.

A further essential advantage of the invention is to be seen in that the proposed solution is highly suitable for retrofits of existing boilers, since using this solution, the heat content of the exhaust gases corresponds to the value which has been established in the preceding staged operation of the boiler. The performance in the lower region of the evaporator can thus be maintained. The upper level, as is the case in previous boilers having staged operation, serves for admixture of the remaining air. As a result of the delivery of heat to the evaporator, the temperatures are relatively low, and a high thermal NOx formation on admixing the air can be prevented.

A further advantage of the invention is additionally to be seen in that, with the addition of air at the end of the precombustion chamber, aggressive highly substoichiometric exhaust gases can be prevented from coming into contact with the evaporator, as a result of which a chemical attack on the tube walls and depositions from fuel-rich zones onto cold walls are prevented.

Advantageous and expedient developments of the solution according to the invention are described in the additional claims.

An embodiment of the invention is described in more detail below referring to the drawing. All elements not immediately required to understand the invention have been eliminated. The direction of flow of the media is indicated by arrows.

BRIEF DESCRIPTION OF THE DRAWINGS

A more complete appreciation of the invention and many of the attendant advantages thereof will be readily obtained as the same becomes better understood by reference to the following detailed description when considered in connection with the accompany drawings, wherein.

DESCRIPTION OF THE PREFERRED EMBODIMENTS

Figure 1:
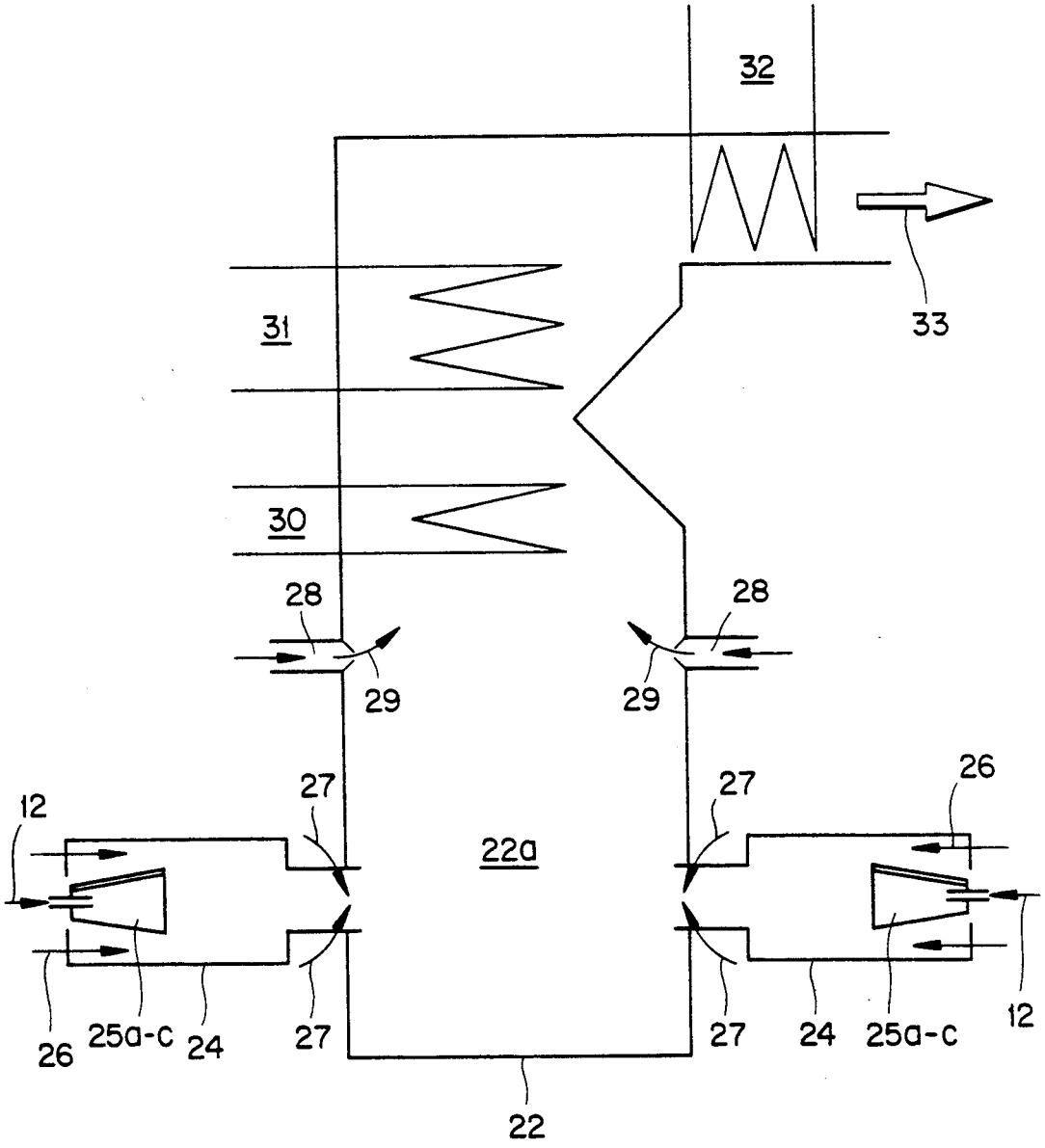
FIG. 1 shows a schematic view of a power station boiler.
Figure 2:
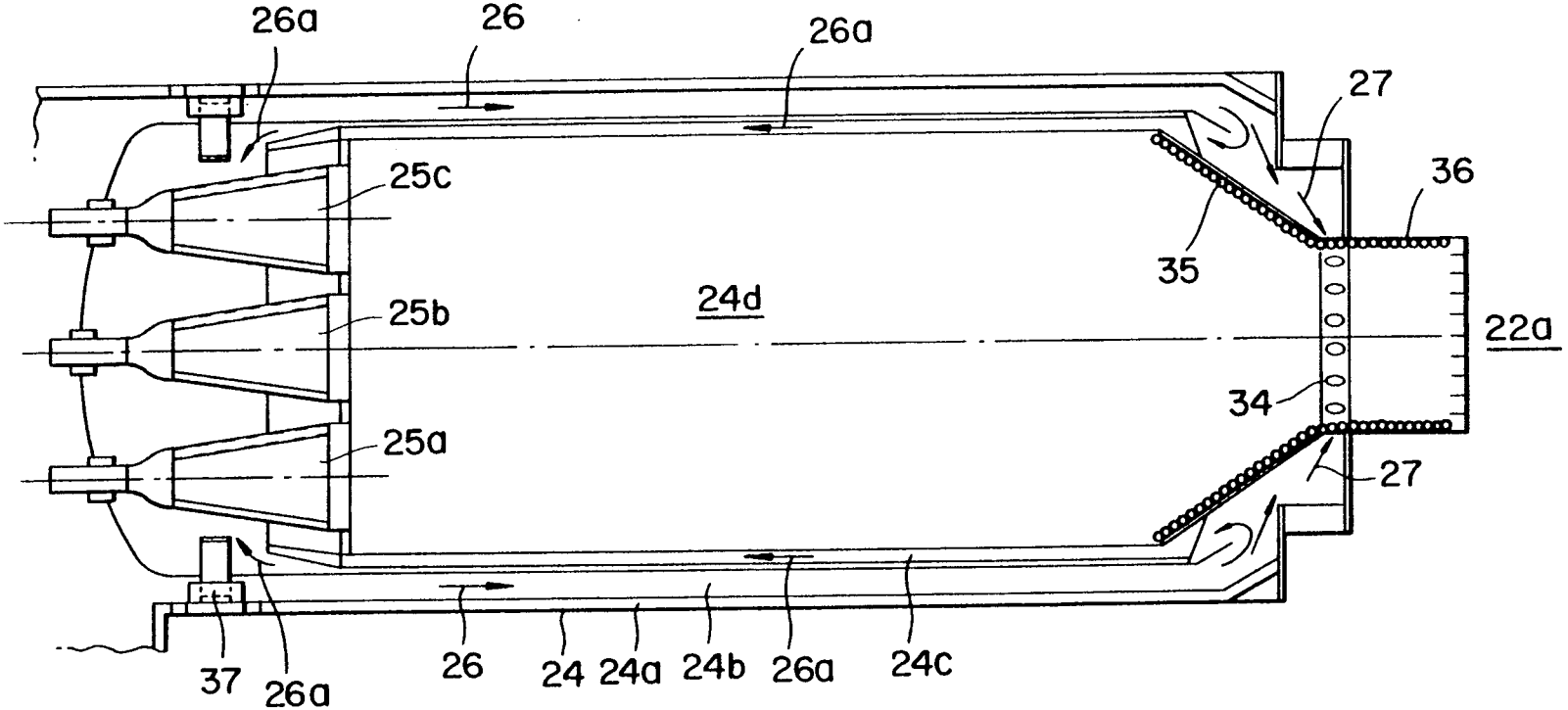
FIG. 2 shows a precombustion chamber, with the heat input from burners distributed on three levels.

Referring now to the drawings, wherein like reference numerals designate identical or corresponding parts throughout the several views, in FIG. 1, a schematic view is shown of a conventional power station boiler 22 for steam generation. In principle this can be a multiple pressure boiler, as the different high pressure, medium pressure and low pressure heat exchangers 30, 31, 32 to be seen downstream of the firing system show. However, the core of the boiler 22 is the actual firing system, which is located at the head of the boiler 22. This is fitted with a series of precombustion chambers 24 which are distributed about the periphery of the boiler 22, and each of which are fitted with at least one burner 25*a–c*. The combustion process of this boiler is carried out using double air staging. The burner 25*a–c* is first operated with a primary air stream, this air being composed of at least one part of fresh air 26, which, as will be explained in detail in FIG. 2, is subjected to a caloric treatment to give primary air. The fuel intended to operate these burners 25*a–c*, is preferably a liquid fuel 12. Other fuels can,, of course, be alternatively used. For the mode of operation of the burner 25*a–c* preferably used here, refer to FIGS. 3-6. A secondary air stream 27, the air in which is a part of the fresh air 26, is, preferably untreated, where a caloric treatment need not be excluded, injected directly at the coupling of the precombustion chamber 24 into the boiler 22. This addition of air at the end of the precombustion chamber 24 prevents aggressive highly substoichiometric exhaust gases from coming into contact with the evaporator 22a, so that a chemical attack on the tube walls, or depositions from fuel-rich zones onto cold walls cannot result. A structural solution of such a precombustion chamber can be seen in FIG. 2. Downstream of the precombustion chambers 24, a number of nozzles 28 are placed on the periphery of the boiler 22, via which nozzles a tertiary air stream 29, as remaining air injection, is introduced into the boiler 22. This upper level, as a site of admixing of the remaining air 29, ensures heat delivery to the evaporator 22a, the temperatures being consequently relatively low, so that high thermal NOx formation on admixture of this air can be prevented. From the stoichiometric point of view, it is to be noted that combustion is carried out in the precombustion chamber using a λ of 0.6-0.65. In the boiler 22 itself, a λ of 0.75 then prevails. Only after the injection of the remaining air 29 does λ increase to 1.05. As a result of the substoichiometric operation of this boiler 22, nitrogen-containing fuel compounds can be reduced. The reduction mechanism is intensified in this as the air preheating increases, with which an indication is given as to how the caloric treatment will proceed. In principle, the residence time of the rich but homogeneous mixture in the precombustion chamber 24, which mixture is produced from fuel 12 and primary air and which is partially burnt in the precombustion chamber 24, must be chosen in such a manner that the decomposition of the nitrogen compounds is highly advanced. At the end of the precombustion chamber 24, in any case a lean gas of very high temperature is present. With this boiler configuration, rapid admixing into the lean gas is achieved, so that it is possible to add a certain quantity of air 27 to the lean gas without an increase in the nitrogen compounds. The reason for this is that these nitrogen compounds have been substantially decomposed in the precombustion chamber 24, but that the state reached is higher than that resulting from the thermodynamic equilibrium for the mixture of primary air (FIG. 2, position 26a) and secondary air 27. As a result, a further reduction proceeds in the evaporator 22a of the boiler 22 after a slight increase in the nitrogen compounds as a result of insufficiently rapid admixing processes. The exhaust gases to the stack are designated by position 33. As already mentioned in the introduction of the description, this technology is highly suitable for refitting existing boilers in a very simple and cheap manner and for operating them with the desired air deficiency at the most suitable place. In the case of existing boilers, the existing fresh air fan can generally be used, if need be supplemented by slight modifications. The same applies to the air preheating, the air distributor, the tertiary air feed, the boiler itself and the exhaust gas fan. As far as the precombustion chamber 24 is concerned, as the heart of the proposed technology, FIG. 2 is referred to.

FIG. 2 shows a precombustion chamber 24. The primary air 26 passes from the air distributor in the head of the precombustion chamber 24 and is distributed uniformly about the periphery. The primary air 26 is conducted in an annular gap 24b to the boiler-side end of the precombustion chamber 24 and, during this, cools both the flame tube and the casing 24a. At the boiler-side end, the air 26 is diverted by 180° and then flows back through the flame tube 24c to the burner side. The flame tube 24c itself is composed of an external cylinder, into which shaped elements are welded along the length. By appropriate selection of the shaped elements, an intensive finning is achievable. This is particularly necessary in the vicinity of the burner, where the highest thermal stresses occur. The air 26 is heated on passage through the flame tube 24c to give combustion air 26a. The burners used are so-called double cone burners 25a, 25b, 25c. The preheated fuel 12 is atomized using steam as the auxiliary medium in the head of the burners 25a, 25b, 25c. The end of the combustion chamber, in which the burners are installed, is furnished with a thermal layer which is not illustrated. The nozzle at the end of the precombustion chamber 24 is water-cooled 35. The water circulation is connected upstream of or in parallel to the evaporator in the boiler 22. The end of the precombustion chamber 24 is preferably characterized by a tapering 36, so that any burner openings already present in the evaporator of the boiler 22 do not have to be enlarged. In the region of the 180° diversion, a part of the primary air 26 is branched off, and, after acceleration of its flow rate, is introduced as secondary air 27 in the form of individual jets via corresponding passageways 34 into the interior 24d of the precombustion chamber 24. This admixture takes place in the region of the tapering 36 of the precombustion chamber 24. This admixture must be admixed as homogeneously and rapidly as possible. Supports 37 are provided in the region of the burners, which supports provide the connection between casing 24a and flame tube 24c. The burners 25a, 25b, 25c are distributed on three levels arranged one above the other per combustion chamber. If, for example, four precombustion chambers 24 are distributed about the periphery of the boiler 22, the installation is accordingly operated using 12 burners. The configuration is particularly advantageous in retrofitting, since the performance of the power station boiler 22 can be varied by this means without additional space requirement or can be adapted to the individual conditions. A larger number of burners per precombustion chamber 24 can clearly be alternatively provided; the precombustion chamber 24 can also be operated with only one burner. The air for primary air 26 and secondary air 27 can be prepared collectively or separately (+1° of freedom).

Figure 3:
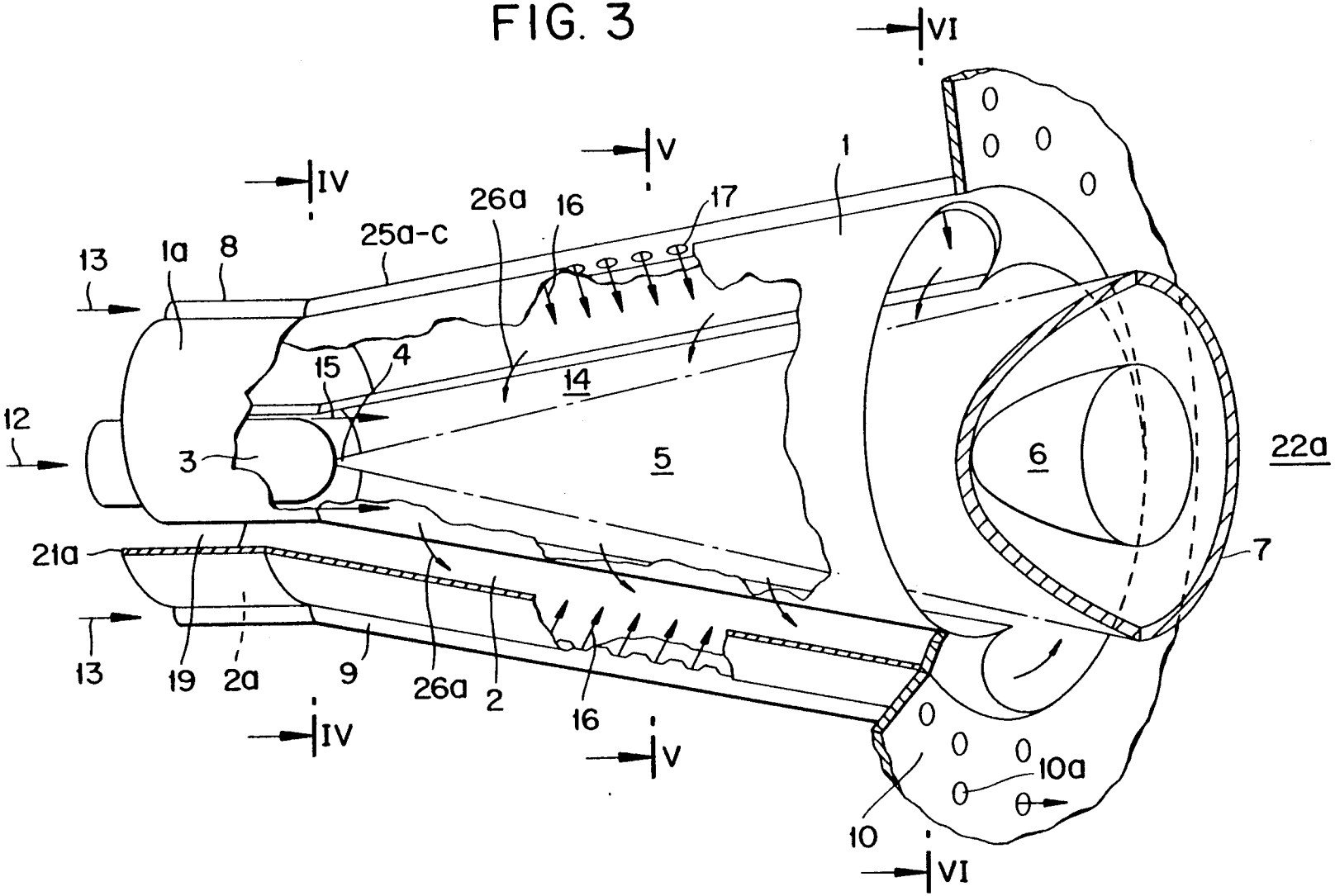
FIG. 3 shows a burner in the form of a conical burner, in perspective view, appropriately sectioned
Figure 4:
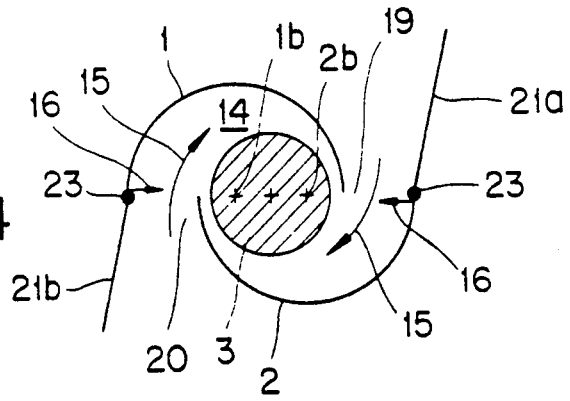
FIGS. 4–6 show corresponding sections through the planes IV—IV (=FIG. 4) , V—V (=FIG. 5) and VI—VI (=FIG. 6), where these sections give only a schematic, simplified depiction of the conical burner according to FIG. 3.
Figure 5:
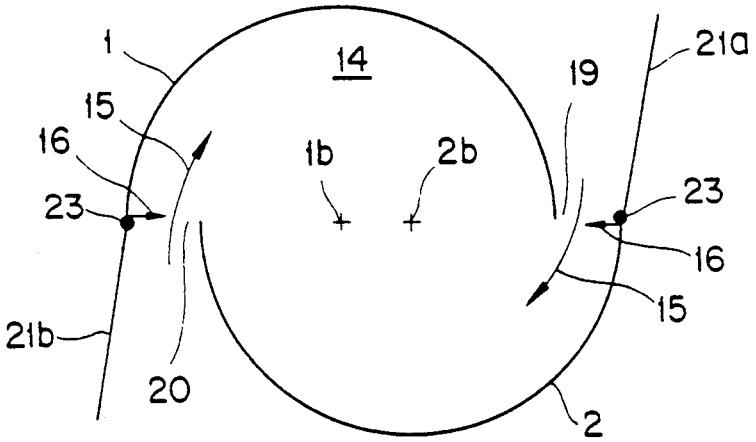
Figure 6:
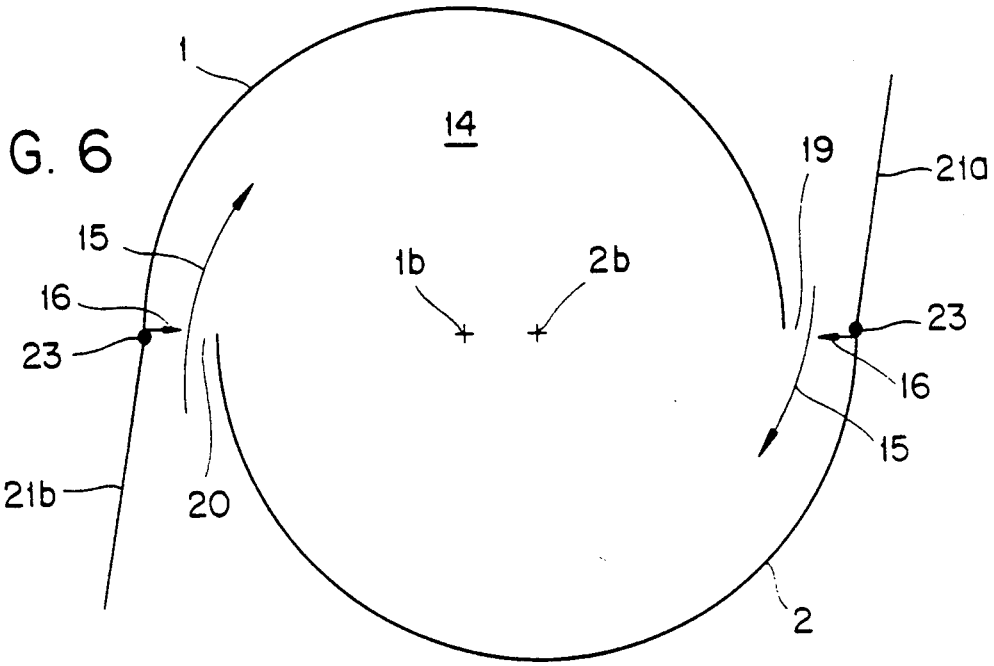

In order to better understand the design of the burner 25a-c, it is advantageous if, simultaneously to FIG. 3, the individual sections depicted therein, corresponding to FIGS. 4-6, are considered. Furthermore, in order to maintain high clarity of FIG. 3, the deflectors 21a, 21b schematically depicted according to FIGS. 4-6 are only recorded indicatively in FIG. 3. In the description of FIG. 3 below, reference will be made continuously as required to the other figures.

The burner 25a-c according to FIG. 3 is composed of two hollow half-cone components 1, 2, which stand one above the other and radially displaced to each other relative to their longitudinal axis of symmetry. The displacement of each longitudinal axis of symmetry 1b, 2b to each other opens a tangential air intake slot 19, 20 on both sides of the components 1, 2, each with opposite direction of inlet flow (compare in this connection FIGS. 4-6), through which the combustion air 26a previously mentioned in the preceding figures flows into the interior 14 of conical shape formed by the conical components 1, 2. The conical shape of the components 1, 2 shown has a defined fixed angle in the direction of flow. Clearly, depending on use, the components 1, 2 in the direction of flow can have a progressive or degressive conical inclination. The two latter shapes are not represented diagrammatically, since they can be readily deduced. The two conical components 1, 2 each have a cylindrical initial part 1*a*, 2*a*, which parts, analogously to the components 1, 2, run displaced to each other, so that the tangential air inlet slots are continuously present over the entire length of the burner 25*a–c*. These initial parts can alternatively take another geometrical form, they can, on occasion, even be completely omitted. A nozzle 3 is located in this cylindrical initial part 1*a*, 2*a*, via which nozzle a fuel 12, preferably oil, or fuel mixture, is injected into the interior 14 of the burner 25*a–c*. This fuel injection 4 roughly coincides with the narrowest cross-sectional area of the interior 14. A further fuel feed 13, here preferably gas, is led via a pipe 8, 9 integral with each of the components 1, 2, and is admixed 16 to the combustion air 26*a*, via a number of nozzles 17. The admixing occurs in the region of the entry into the interior 14, in order to achieve an optimal rate-dependent admixing 16. Clearly, mixed operation using both fuels 12, 13 is possible via each injection. On the precombustion chamber side 24, the outlet orifice of the burner 25*a–c* becomes a front wall 10, in which a number of holes 10*a* are provided, in order to inject, as required, a defined amount of dilution air or cooling air into the interior 24*d* of the precombustion chamber 24. The liquid fuel 12 led through nozzle 3 is injected into the interior 14 at an acute angle, in such a manner that along the length of the burner 25*a–c* up to the burner outlet plane a conical spray pattern as homogeneous as possible is established, which is only possible, if the interior walls of the components 1, 2 are not wetted by the fuel injection 4, which can be, for example, an air-assisted nozzle or a pressure atomization. For this purpose, the conical liquid fuel shape pattern 5 is enclosed by the tangentially inflowing combustion air 26*a* and, as required, by a further axially led combustion air stream 15. In the axial direction, the concentration of the injected liquid fuel or mixture 12 is continuously decreased as a result of the combustion air 26*a*, which can alternatively y be a fuel/air mixture, flowing into the interior 14 of the burner 25*a–c* through the tangential air inlet slots 19, 20, if need be, with assistance from the other combustion air stream 15. In connection with the injection of the liquid fuel 12, in the region of the eddy bursting, that is in the region of the reverse flow zone 6, the optimal homogeneous fuel concentration is achieved over the cross section. Ignition is performed at the tip of the reverse flow zone 6. A stable flame front 7 can only result at this position. A flash back of the flame into the interior of the burner 25*a–c*, as is potentially always the case in known premixing lengths, against which in these cases assistance is sought from complicated flame holders, is not to be feared in this case. If the combustion air 26*a*, 15 is preheated, accelerated complete vaporization of the fuel is established before the point at the outlet of the burner 25*a–c* is reached at which the ignition of the mixture takes place. Treatment of the combustion air streams 26*a*, 15 can be extended by admixing recirculated exhaust gas. Narrow limits are to be maintained in the design of the conical components 1, 2, with regard to conical angle and width of the tangential air inlet slots 19, 20, so that the desired field of flow of the combustion air streams is established with their reverse flow zone 6 in the region of the burner mouth to give a flame stabilization. Generally it can be stated that a change of the width of the air inlet slots 19, 20 leads to a displacement of the reverse flow zone 6: the displacement is in the downstream direction for a diminution of the air inlet slots. However, it should be stressed that once the reverse flow zone 6 has been fixed, it is inherently stable with regard to position, since the spin number increases in the direction of flow in the region of the burner 25*a–c*. As already indicated, the axial velocity can be altered by an appropriate feed of the axial combustion air stream 15. The construction of the burner is highly suitable to alter the tangential air inlet slots 19, 20, in accordance with requirements, by which means, without changing the length of the burner 25*a–c*, a relatively large operating range can be encompassed.

FIGS. 4–6 now show the geometrical configuration of the deflectors 21*a*, 21*b*. They have a flow introduction function, where, depending on their length, they extend each end of the conical components 1, 2 in the inflow direction of the combustion air 26*a*. The channeling of the combustion air 26*a* into the interior 14 of the burner 25*a–c* can be optimized by opening or closing of the deflectors 21*a*, 21*b* about a point of rotation 23 placed in the region of the inlet into the interior 14, this is necessary in particular, when the original gap size of the tangential air inlet slots 19, 20 is changed. Obviously,, the burner 25*a–c* can alternatively be operated without deflectors 21*a*, 21*b*, or other aids for this can be provided.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for low-pollutant combustion in a power station boiler, the boiler including at least one precombustion chamber acting on the boiler, and at least one heat exchanger being positioned in the boiler, comprising the steps of:

preheating primary combustion air;

feeding the preheated primary combustion air to a double cone premixing burner to provide a mixture of fuel and combustion air;

combusting the mixture to produce a flame at an outlet of the burner in the precombustion chamber;

injecting secondary combustion air into the precombustion chamber in a conduit between the precombustion chamber and the boiler, the secondary air being injected at a speed sufficient to prevent formation of nitrogen compounds;

allowing heated gas from the precombustion chamber to flow into the boiler; and injecting tertiary combustion air into the boiler downstream of the precombustion chamber and upstream of the heat exchanger.

2. The process as claimed in claim 1, wherein a $\lambda$ of 0.60–0.65 prevails in the precombustion chamber, a $\lambda$ of 0.75 prevails downstream of the precombustion chamber and upstream of the injection of the tertiary air stream, and a $\lambda$ of 1.05 prevails downstream of the injection of the tertiary air stream.

3. The process as claimed in claim 1, wherein the precombustion chamber is operated with burners distributed on three levels situated one above the other.

4. The process as claimed in claim 1, wherein the secondary air is injected into the precombustion chamber via a number of openings in a region of the precombustion chamber tapering to form a nozzle entering the boiler.

5. The process as claimed in claim 1, wherein the burner comprises in the direction of flow at least two hollow, partial conical components positioned to form a conical interior cavity, longitudinal axes of symmetry of the components being radially displaced from each other in a manner creating tangential inlet slots with opposite flow directions for a combustion air stream into the conical cavity, at least one nozzle being placed in the conical cavity, the injection of a fuel from which lies in the center of the longitudinal axes of symmetry of the conical components further comprising the steps of injecting a fuel in the burner nozzle and allowing the fuel to mix with the combustion air stream in the conical cavity.

6. The process as claimed in claim 5, wherein the burner comprises further nozzles for injecting a further fuel in the region of the tangential inlet slots further comprising the step of injecting a further fuel into the tangential inlet slots.

7. A boiler apparatus for a power plant, comprising:

a boiler having a head end;

at least one precombustion chamber connected to the boiler at the head end for feeding combustion gases to the boiler, the precombustion chamber having a burner end and a boiler end, an outer casing, an inner casing, a gap between the outer and inner casings forming an annular flow passage for a flow of primary combustion air from an entry at the burner end to the boiler end, the inner casing narrowing at the boiler end to form a nozzle connecting to the boiler, a flame tube attached to the inner casing to carry primary combustion air from the annular space at the boiler end to the burner end, at least one premixing burner mounted in the inner casing at the burner end with a burner outlet opening into the inner casing, the flame tube feeding primary combustion air to the burner, and a plurality of air jets connecting the annular passage to the inner casing at the nozzle for injecting a secondary combustion air into the inner casing; and a plurality of nozzles connected to the boiler downstream of the precombustion chamber for injecting a tertiary air flow into the boiler.

8. The boiler apparatus as claimed in claim 7, wherein the burner comprises at least two hollow, partial conical components positioned to form a conical cavity extending in a longitudinal direction of flow, longitudinal axes of symmetry of the components being radially displaced from each other in a manner forming longitudinal inlet slots on opposing sides of the conical cavity for a tangential flow of combustion air into the conical cavity, and at least one nozzle being placed in the conical cavity for the injection of a fuel into the conical cavity directed between the longitudinal axes of symmetry.

9. The boiler as claimed in claim 8, wherein the burner further comprises further nozzles for injecting a further fuel, the nozzles being mounted in a region of the tangential inlet slots so that the further fuel is carried into the cavity by the tangential flow of combustion air.

10. The boiler as claimed in claim 8, wherein the components broaden conically in the direction of flow at a fixed angle.

* * * * *